US008324533B2

(12) United States Patent
Lee

(10) Patent No.: US 8,324,533 B2
(45) Date of Patent: Dec. 4, 2012

(54) DUAL-PERSON ELECTRIC HEATING BLANKET

(76) Inventor: Shu Chiu Lee, Keelung (TW)

( * ) Notice: Subject to any disclaimer, the term of this patent is extended or adjusted under 35 U.S.C. 154(b) by 1091 days.

(21) Appl. No.: 12/285,589

(22) Filed: Oct. 9, 2008

(65) Prior Publication Data

US 2010/0089898 A1 Apr. 15, 2010

(51) Int. Cl.
*H05B 3/00* (2006.01)
*H01H 35/02* (2006.01)

(52) U.S. Cl. ..... 219/212; 200/61.45 R

(58) Field of Classification Search ..... 219/211, 219/212, 527–529, 542–549, 483, 486, 487, 219/490, 491, 507–511; 200/61.45 R, 61.52
See application file for complete search history.

(56) References Cited

U.S. PATENT DOCUMENTS 3,634,655 A * 1/1972 Jordan ..... 219/527
4,162,393 A * 7/1979 Balboni ..... 219/217
4,659,905 A * 4/1987 Gabrosek et al. ..... 219/212
5,948,303 A * 9/1999 Larson ..... 219/486
2003/0052120 A1* 3/2003 Zabrowsky et al. ..... 219/501

* cited by examiner

*Primary Examiner* — Sang Paik
(74) *Attorney, Agent, or Firm* — Bacon & Thomas, PLLC

(57) ABSTRACT

A dual-person electric heating blanket having a receiving bag and a remote controller, the receiving bag has therein a first and a juxtaposed second heating wire which are connected with a controller box; the remote controller includes a circuit board being electrically connected, a pattern interface, a switchable switch and a signal emitting end; the pattern interface has thereat a first and a second position juxtaposed with each other, the first position has thereat a first pattern, and the second position has thereat a second pattern, the first and second patterns are respectively connected with a first and a second circuit on the circuit board; thereby, when a user faces to a front or a rear end of the receiving bag, by switching between the first and second circuits with the switchable switch, the first pattern corresponds to the first heating wire and the second pattern corresponds to the second heating wire, and by emitting control signal from the signal emitting end, heating temperatures of the two sets of heating wires are controlled respectively.

8 Claims, 9 Drawing Sheets

DUAL-PERSON ELECTRIC HEATING BLANKET

BACKGROUND OF THE INVENTION

1. Field of the Invention

The present invention relates to an electric heating blanket, and more particularly to a dual-person electric heating blanket with which when a user faces to the front or the rear end of a receiving bag of the blanket, two patterns (a right pattern and a left pattern) arranged parallelly on a remote controller and can be changeably controlled, this makes a user to manipulate conveniently and correctly two heating wires in the receiving bag, and confusion can be avoided.

2. Description of the Prior Art

For the people who live in colder districts and who are physically weaker, it is popular from them to use electric heating blankets during sleeping. The conventional electric heating blankets available in the markets presently mainly include two kinds, namely, one-person and dual-person electric heating blankets. Wherein the conventional one-person electric heating blankets each has a sets of heating wires in a receiving bag; while as shown in FIG. 11, a conventional dual-person electric heating blanket (a) is provided in a receiving bag (b) with two sets of heating wires (c1, c2) connecting respectively with two controllers (d1, d2), in order that when two persons lie parallelly together, heating temperatures of the heating wires (c1, c2) can be adjusted according to each individual requirements.

When in use, the conventional dual-person electric heating blanket surely can have the heating temperatures of the two sets of heating wires controlled by two different controllers, however, the two sets of heating wires must be connected to the two controllers, it costs more when manufacturing this conventional electric heating and it is more troublesome for the user for controlling the heating wires in the wire controlling mode.

In view of these, and in order to get rid of the above defects and to make the two sets of heating wires of the dual-person electric heating blanket be controlled and adjusted by a remote controller according to the requirement of a user, and further to have the manufacturing cost reduced, to make the user manipulate conveniently and correctly when he is at a different position, the inventor provides the present invention based on his experience of years and nonstop study and development.

SUMMARY OF THE INVENTION

The primary object of the present invention is to provide a dual-person electric heating blanket which is provided in a receiving bag for two persons with two sets of heating wires in connecting with a controller box, and with a remote controller for manipulating the two sets of heating wires respectively, thereby the cost of manufacturing can be reduced, and the use for the user can be convenient.

The secondary object of the present invention is to provide a dual-person electric heating blanket which is provided on the remote controller with an automatic switchable switch in order to make switching between a first and a second (or a left and right) pattern juxtaposed with each other on a pattern interface, thereby the user can correctly control the heating temperatures of the two sets of heating wires when he (she) faces to the front or the rear end of the receiving bag of the blanket.

Another object of the present invention is to provide a dual-person electric heating blanket which is provided on the remote controller with an automatic switchable switch in order to make switching between a first and a second (or a up and down) pattern juxtaposed with each other on a pattern interface, thereby the user can definitely distinguish the position of the user relative to the receiving bag when he (she) faces to the front or the rear end of the receiving bag of the blanket, in order to make the user convenient in controlling the two sets of heating wires in the receiving bag.

For achieving the above objects, the dual-person electric heating blanket provided in the present invention includes a receiving bag and a remote controller. The receiving bag is provided therein with a first heating wire and a second heating wire juxtaposed with each other, the first and the second heating wires are connected with a controller box, which includes a signal receiver end and two control circuits. The remote controller includes an electric circuit board being electrically connected, a pattern interface, a switchable switch and a signal emitting end, the circuit board is provided therewith a first circuit and a second circuit, the pattern interface has thereat first and a second position juxtaposed with each other, the first position has thereat first pattern, and the second position has thereat second pattern and the first and second circuits are respectively connected with the first and second patterns.

Thereby, when a user faces to the front or the rear end of the receiving bag of the blanket, by switching between the first and second circuits with the switchable switch to make the first pattern correspond to the first heating wire and the second pattern correspond to the second heating wire, and by emitting control signal from the signal emitting end, heating temperatures of the two sets of heating wires can be controlled through the two control circuits respectively.

The present invention will be apparent after reading the detailed description of the preferred embodiments thereof in reference to the accompanying drawings.

DETAILED DESCRIPTION OF THE PREFERRED EMBODIMENT

Figure 1:
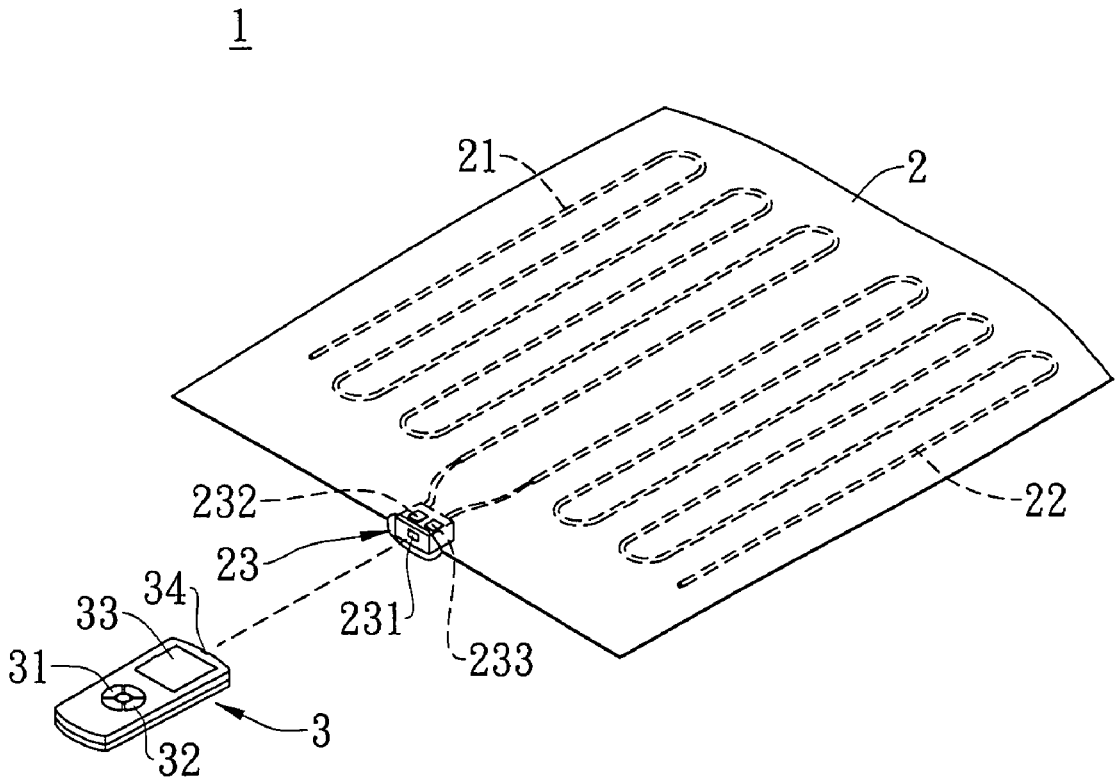
FIG. 1 is a perspective view showing the appearance of an embodiment of the present invention.
Figure 2:
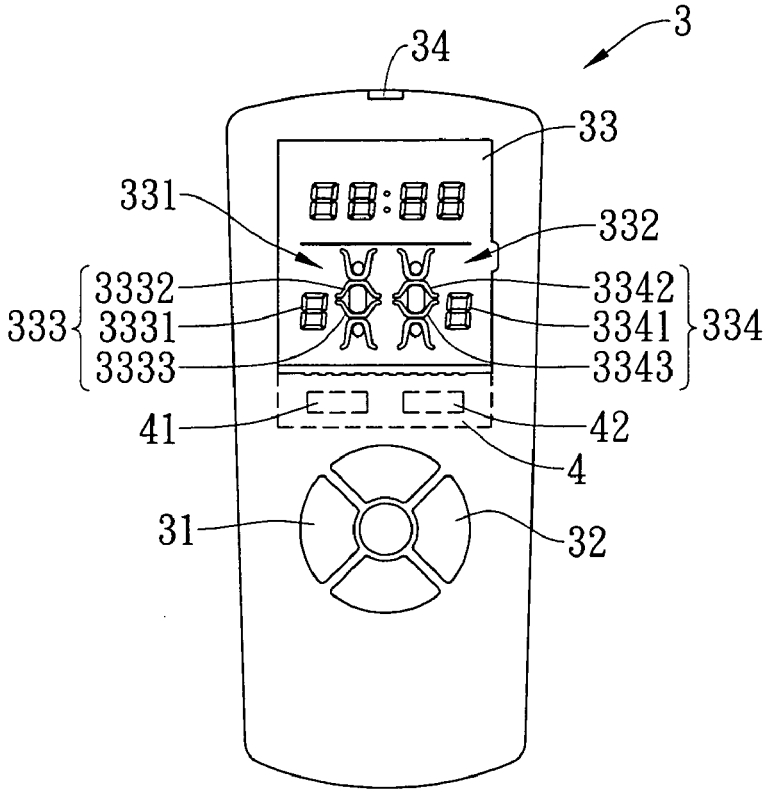
FIG. 2 is a top view of a remote controller of the embodiment of the present invention.

Referring to FIGS. 1 and 2 showing a preferred embodiment of the dual-person electric heating blanket 1 of the present invention, the heating blanket 1 includes a receiving bag 2—and a remote controller 3.

The receiving bag 2 is provided therein with a first heating wire 21 and a second heating wire 22 juxtaposed with each other and bent to form tortuous shapes, the first and the second heating wires 21, 22 are connected with a controller box 23 which includes an infrared signal receiver end 231, a first control circuit 232 and a second control circuit 233, the two control circuits 232, 233 are connected respectively to the first and the second heating wires 21, 22 to control heating temperatures of the two sets of heating wires 21, 22 respectively.

Figure 3:
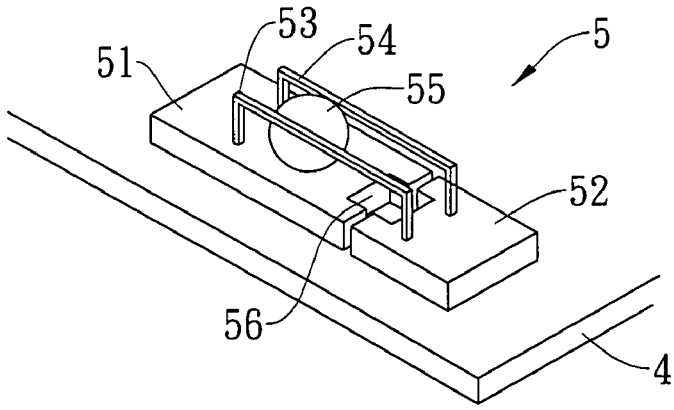
FIG. 3 is a perspective view showing a switchable switch of the remote controller of the embodiment of the present invention.

The remote controller 3 is in a rectangular shape, it is provided on its surface with a left and a right push button 31, 32, and a pattern interface 33 which is a liquid crystal screen; the remote controller 3 is provided on its front end with an infrared signal emitting end 34, and the remote controller 3 has therein an electric circuit board 4 and a switchable switch 5 that are positioned (as shown in FIG. 3); wherein the left and the right push buttons 31, 32, the pattern interface 33, the infrared signal emitting end 34 and the switchable switch 5 are all electrically connected with the electric board 4; while the electric circuit board 4 is provided thereat with a first circuit 41 and a second circuit 42.

The pattern interface 33 has thereat a first and a second position 331, 332 juxtaposed with each other, the first position 331 has thereat a first pattern 333, and the second position 332 has thereat a second pattern 334, the first and second patterns 333, 334 are respectively connected with the first and second circuits 41, 42. In practicing, the first and the second circuits 41, 42 can be integrated into a circuit. The first pattern 333 has a first temperature display 3331, a third pattern 3332 and a fifth pattern 3333; the second pattern 334 includes a second temperature display 3341, a fourth pattern 3342 and a sixth pattern 3343. In this embodiment, the third pattern 3332 and the fourth pattern 3342 on the pattern interface 33 are each in a simple shape of a man facing to us, while the fifth pattern 3333 and the sixth pattern 3343 are each in a simple shape of a man facing to us upside-down; part of the fifth pattern 3333 overlaps the third pattern 3332, and part of the sixth pattern 3343 overlaps the fourth pattern 3342; in practicing, the third, the fourth, the fifth and the sixth patterns 3332, 3342, 3333 and 3343 can also be spaced away and arranged in a line rather than partly overlap.

As shown in FIG. 3, the switchable switch 5 includes a first raised plate 51, a second raised plate 52, a first conductor 53, a second conductor 54 and a metallic ball 55.

The first and the second raised plates 51, 52 are two insulating plates provided in mutual juxtaposed state in the electric circuit board 4, and a slit 56 is formed between the first and the second raised plates 51, 52. The first and the second conductors 53, 54 are both inversed U shaped, one leg of the first conductor 53 and one leg of the second conductor 54 are respectively connected to the first raised plates 51, while the other leg of the first conductor 53 and the other leg of the second conductor 54 are respectively connected to the second raised plates 52, in order that the first and the second conductor 53, 54 straddle over the surface of the first and the second raised plates 51, 52 in mutual juxtaposed state; while the metallic ball 55 is placed on and limited between the surfaces of the first and the second raised plates 51, 52, so that the metallic ball 55 can only roll limitedly linearly. When in practicing, the first and the second raised plates 51, 52 can also be substituted by an integrally formed raised plate; the slit 56 is formed on the raised plate, and the first and the second conductors 53, 54 straddle over the slit 56.

Figure 4:
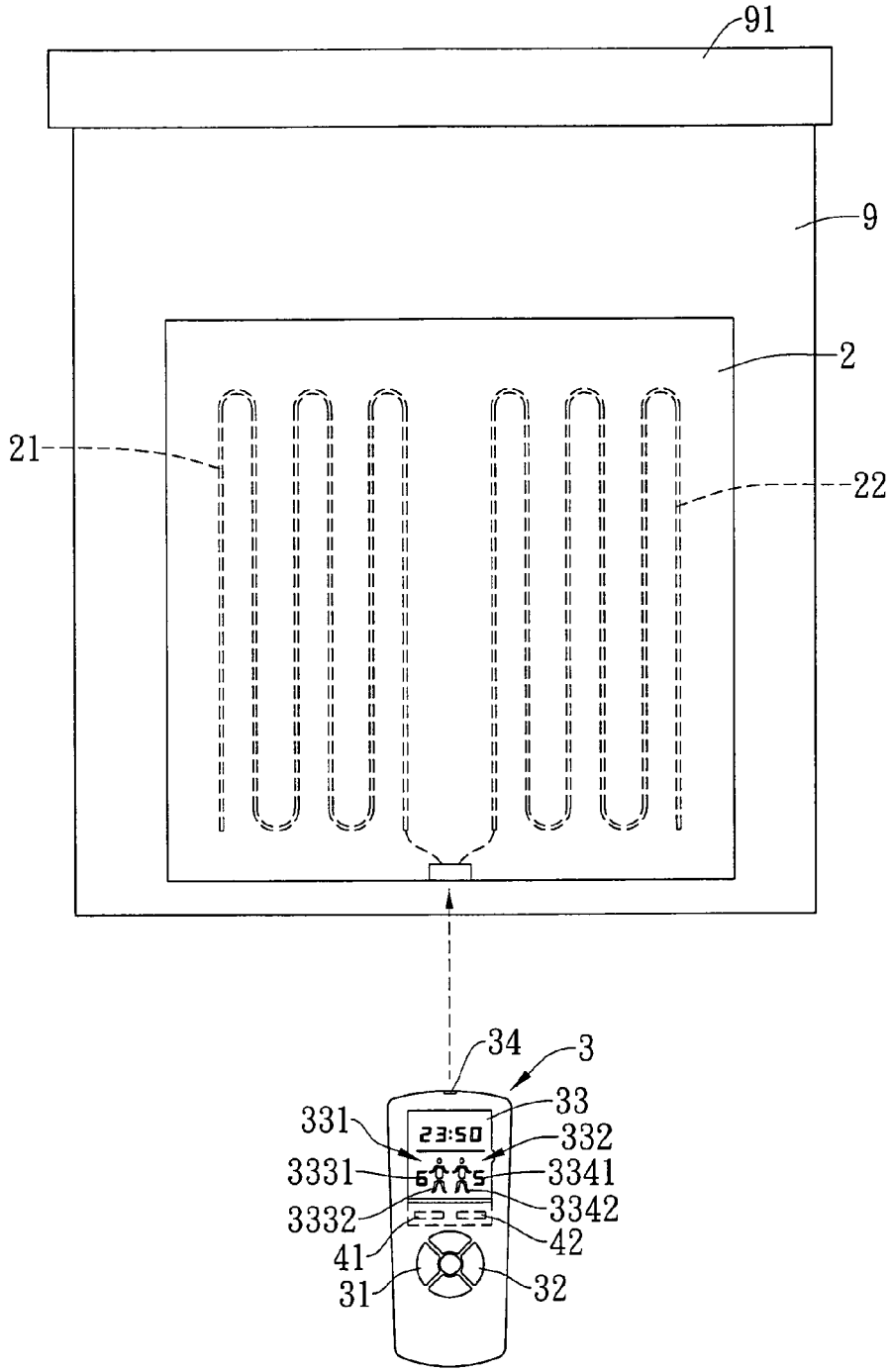
FIG. 4 is a schematic view showing use of the embodiment of the present invention when a user faces to the head end of a bed.
Figure 5:
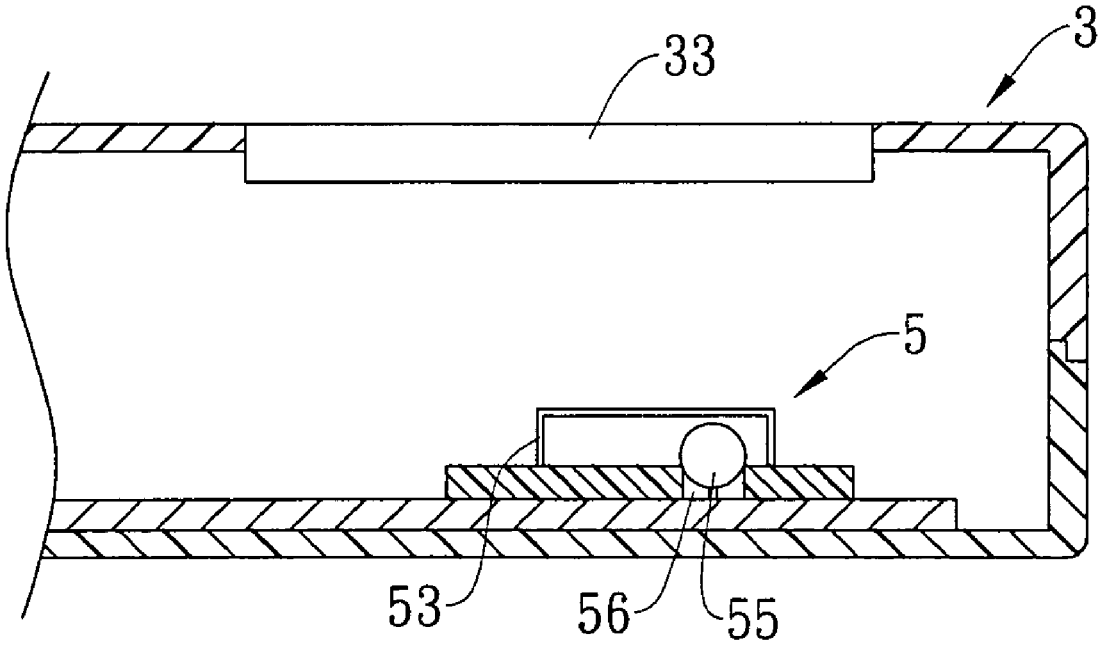
FIG. 5 is a schematic sectional view showing the switchable switch of the embodiment of the present invention in a horizontal position.

Referring to FIGS. 4, 5 showing use of the embodiment of the present invention, in the drawing, when the receiving bag 2 is laid on a bed 9, put the receiving bag 2 near the head end 91 of the bed, the end is defined as a font end, while the end near the tailing end of the bed is defined as a rear end, the user holds the remote controller 3 horizontally and faces to the head end 91 of the bed, namely, faces to the front end of the receiving bag 2 to proceed to an action of preheating; as shown in FIG. 5, by virtue that the switchable switch 5 is in a horizontal position, the metallic ball 55 falls into the slit 56 and is separated from the first and the second conductors 53, 54. In this state, by driving of the first and the second circuits 41, 42, the first position 331 of the pattern interface 33 shows the first temperature display 3331 and the third pattern 3332, while the second position 332 shows the second temperature display 3341 and the fourth pattern 3342. At this time, the third pattern 3332 facing to us at the first position 331 on the left side of the remote controller 3 corresponds with the first heating wire 21, and the fourth pattern 3342 facing to us at the second position 332 on the right side of the remote controller 3 corresponds with the second heating wire 22. When the user presses the left and the right push buttons 31, 32 of the remote controller 3, heating temperatures of the first and the second heating wires 21, 22 can be adjusted respectively through signal control by the infrared signal emitting end 34.

Figure 6:
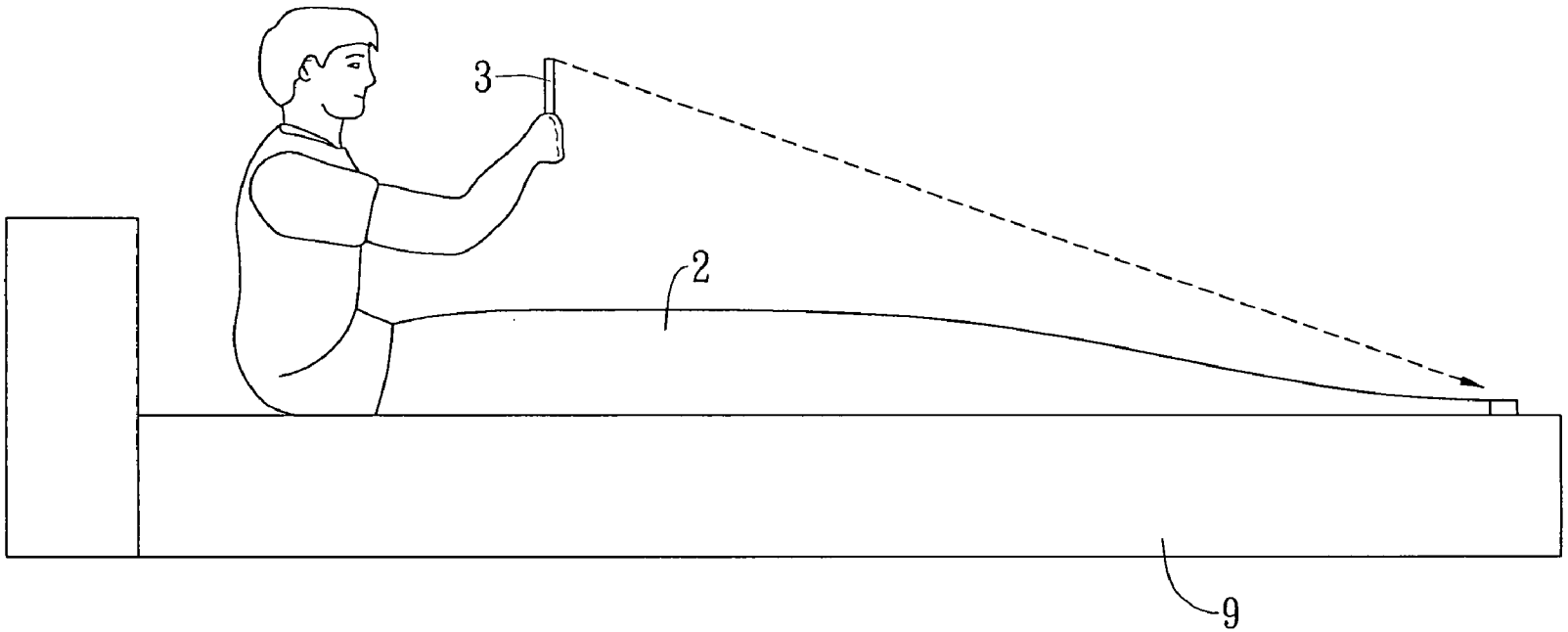
FIG. 6 is a schematic view showing use of the embodiment of the present invention when the user faces to the tailing end of the bed.
Figure 7:
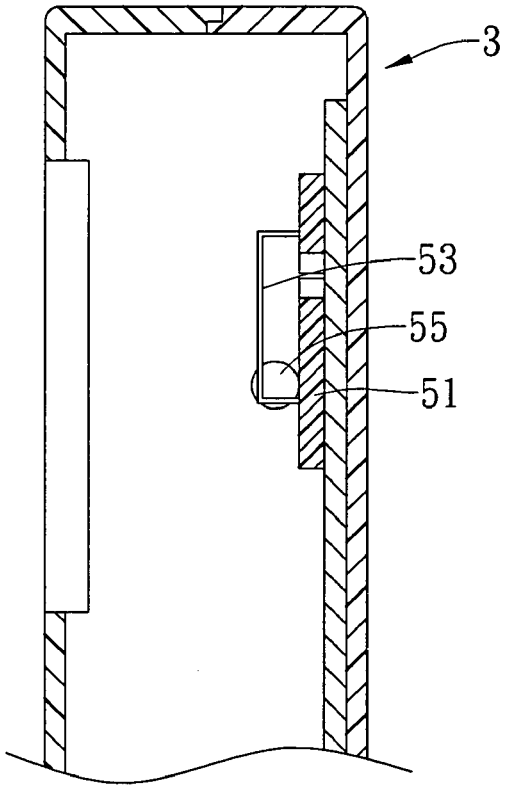
FIG. 7 is a schematic sectional view showing the switchable switch of the embodiment of the present invention in an upright position.
Figure 8:
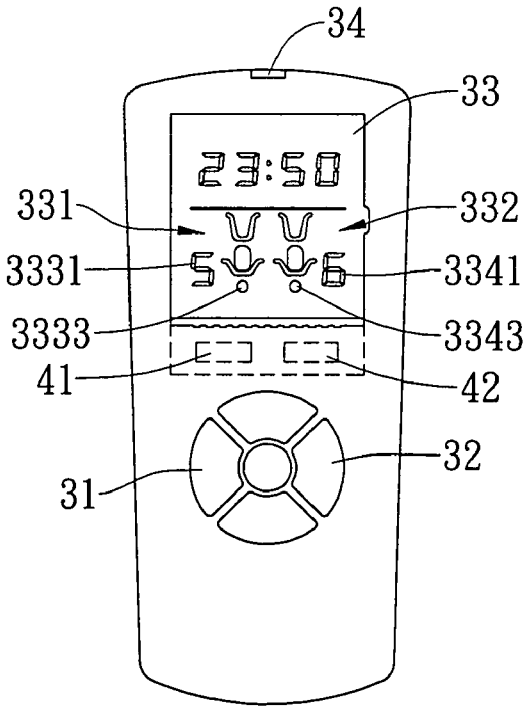
FIG. 8 is a schematic view showing the state of a pattern interface displayed in use of the embodiment of the present invention when the user faces to the tailing end of the bed.

Referring to FIG. 6 showing the other state of use of the embodiment of the present invention, when the user gets on the bed 9, he seats on the bed 9 facing to the tailing end of the bed 9, namely facing to the rear end of the receiving bag 2 and holds the remote controller 3 upright in order to do adjustment with the first and the second heating wires 21, 22, as shown in FIGS. 3, 7, by the action of gravity, the metallic ball 55 rolls down along the first and the second conductors 53, 54, and is positioned between the first and the second conductors 53, 54 on the first raised plate 51, the metallic ball 55 thereby simultaneously contacts both the first and the second conductors 53, 54 to make connection of the two conductors 53, 54 for switching between the first and second circuits 41, 42. Hence as shown in FIG. 8, the first position 331 of the pattern interface 33 shows the first temperature display 3331 and the fifth pattern 3333, while the second position 332 shows the second temperature display 3341 and the sixth pattern 3343. At this time, the fifth pattern 3333 at the first position 331 on the left side of the remote controller 3, which is in a simple shape of a man facing to us upside-down, corresponds with the first heating wire 21 on the left side of the receiving bag 2; while the first temperature display 3331 is switched to show the temperature of the first heating wire 21; the sixth pattern 3343 at the second position 332 on the right side of the remote controller 3, which is also in a simple shape of a man facing to us upside-down, corresponds with the second heating wire 22 on the right side of the receiving bag 2, at the same time, the second temperature display 3341 is switched to show the temperature of the second heating wire 22, in this way, the user can press the left and the right push buttons 31, 32 of the remote controller 3, heating temperatures of the first and the second heating wires 21, 22 can thus be adjusted respectively.

Figure 9:
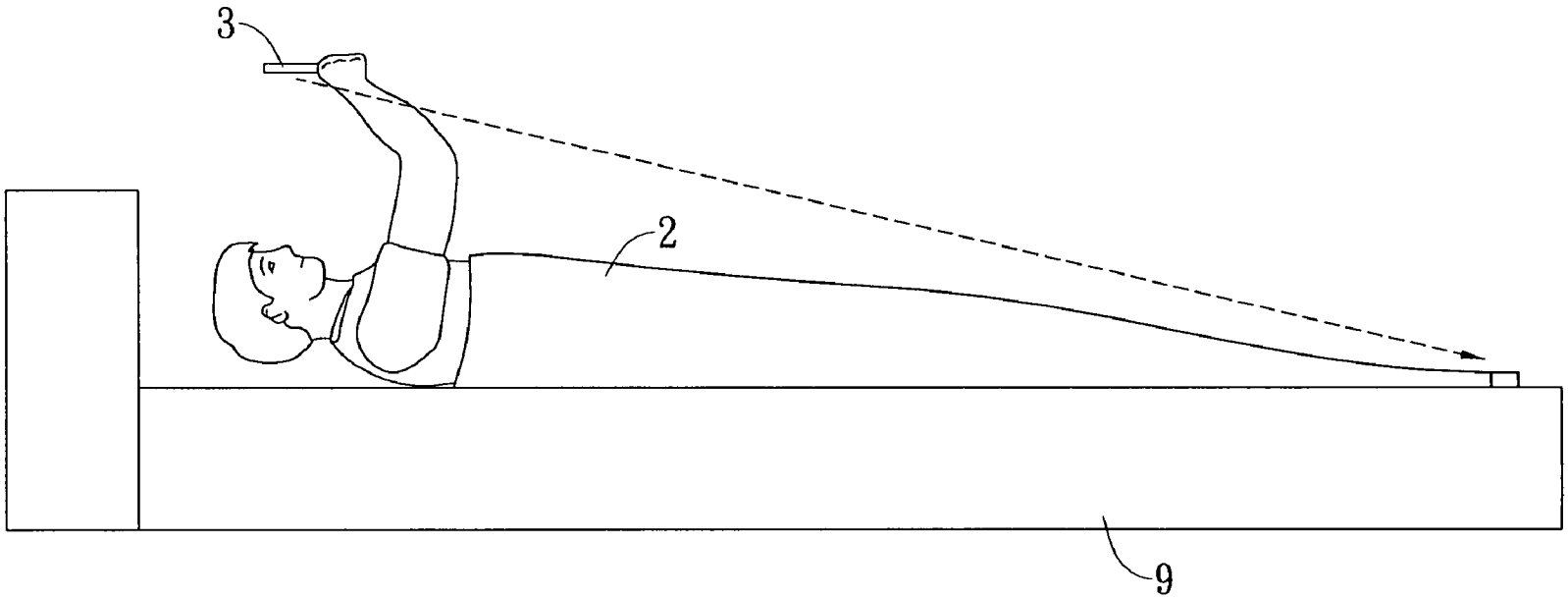
FIG. 9 is a schematic view showing use of the embodiment of the present invention when the user is lying on the bed and holding the remote controller above himself.
Figure 10:
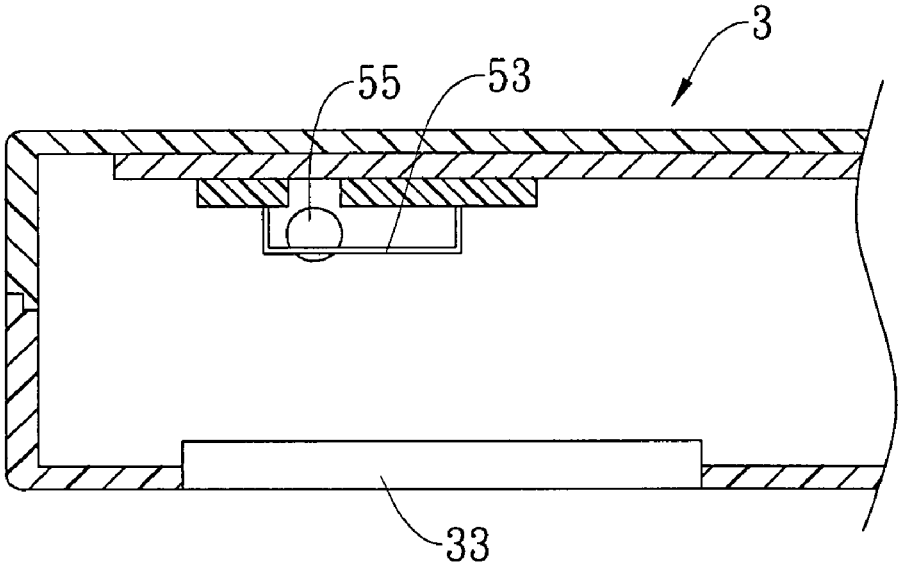
FIG. 10 is a schematic sectional view showing the switchable switch of the embodiment of the present invention is used with the pattern interface faced down.
Figure 11:
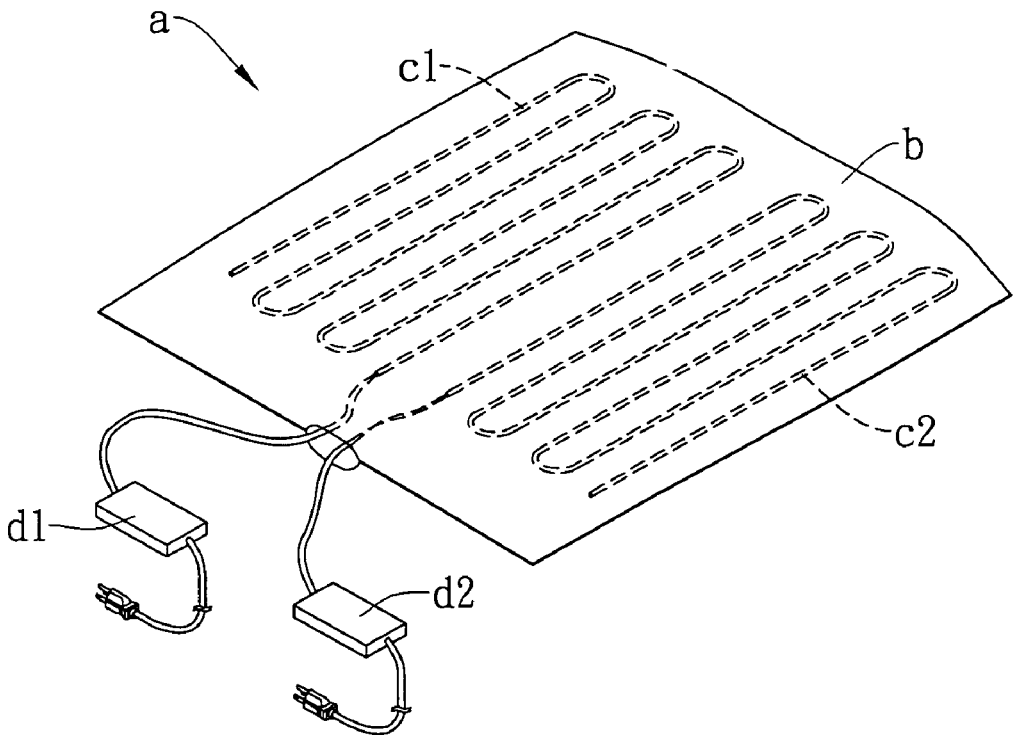
Fig. 11 (Prior Art)
FIG. 11 is a perspective view showing the appearance of a conventional dual-person electric heating blanket.

Referring to FIG. 9, when the user lies on the bed 9 and holds the remote controller 3 above himself to do adjustment of temperature, such as is shown in FIGS. 3 and 10, by the fact that the metallic ball 55 falls down and is supported by the first and the second conductors 53, 54, the metallic ball 55 simultaneously contacts both the first and the second conductors 53, 54 to make connection of the two conductors 53, 54, thus a figure is formed in the pattern interface 33 such as is shown in FIG. 8, the user can thereby manipulate heating temperatures respectively of the first and the second heating wires 21, 22 in the receiving bag 2 conveniently in the same mode as in the previous paragraph, and confusion will not be incurred.

Therefore, the present invention has the following advantages:

1. The present invention can control two sets of heating wires respectively with a remote controller, not only can effectively reduce cost of manufacturing, and can be convenient for use by a user.
2. The present invention allows the user to lie on the bed facing to the tailing end of the bed or lying on the bed, then the user can automatically switch to a control mode for switching between two juxtaposed left and right or first and second patterns, in order to effectively avoid directional confusion, and temperatures of the two sets of heating wires in a receiving bag can be correctly controlled.
3. The present invention allows the user to lie on the bed facing to the tailing end of the bed or lying on the bed, then the user can automatically switch a third and a fourth pattern to a fifth pattern and a sixth pattern both being upside-down, in order that the user can correctly distinguish direction conveniently to control temperatures of the two sets of heating wires.

In conclusion, the present invention surely can get the expected objects thereof to provide a dual-person electric heating blanket that not only to remote control and adjust temperatures of different heating wires according to requirement of a user, but also make the user manipulate the present invention correctly when he is at any of different positions, in order that confusion can be avoided. Having now particularly described and ascertained the nature of my invention, which is extremely industrially valuable, what I claim will be declared in the claims followed.

The invention claimed is:

1. A dual-person electric heating blanket comprising:

a receiving bag, said receiving bag is provided therein with a first heating wire and a second heating wire juxtaposed with each other, said first and second heating wires are connected with a controller box which includes a signal receiver end and two control circuits with which heating temperatures of said two sets of heating wires are controlled respectively; and a remote controller including an electric circuit board being electrically connected, a pattern interface, a switchable switch and a signal emitting end, wherein said circuit board is provided therewith a first circuit and a second circuit, said pattern interface has thereat a first and a second position juxtaposed with each other, said first position has thereat a first pattern, and said second position has thereat a second pattern, said first and said second circuits are respectively connected with said first and second patterns;

wherein said switchable switch includes a first raised plate, a second raised plate, an inversed U shaped first conductor, an inversed U shaped second conductor and a metallic ball, said first and said second raised plates are juxtaposed with each other, and a slit is formed between said first and said second raised plates, said first and said second conductors are juxtaposed with each other, one leg of said first conductor and one leg of said second conductor are respectively connected to said first raised plates, while another leg of said first conductor and another leg of said second conductor are respectively connected to said second raised plates; while said metallic ball is placed between said first and said second conductors on said first and said second raised plates;

thereby, when a user faces to a front or a rear end of said receiving bag, by switching between said first and said second circuits with said switchable switch, said first pattern corresponds to said first heating wire and said second pattern corresponds to said second heating wire, and by emitting control signal from said signal emitting end, heating temperatures of said two sets of heating wires are controlled respectively.

2. The dual-person electric heating blanket as in claim 1, wherein said remote controller is provided therewith two push buttons which are connected to an electric circuit board to respectively control said two control circuits, and to respectively adjust heating temperatures of said two sets of heating wires.

3. The dual-person electric heating blanket as in claim 1, wherein said first and second circuits are integrated into a circuit.

4. The dual-person electric heating blanket as in claim 1, wherein said first and said second raised plates are integrally formed.

5. A dual-person electric heating blanket comprising:

a receiving bag, said receiving bag is provided therein with a first heating wire and a second heating wire juxtaposed with each other, said first and second heating wires are connected with a controller box which includes a signal receiver end and two control circuits with which heating temperatures of said two sets of heating wires are controlled respectively; and a remote controller including an electric circuit board being electrically connected, a pattern interface, a switchable switch and a signal emitting end, where said circuit board is provided therewith a first circuit and a second circuit; said pattern interface has thereat a first and a second position juxtaposed with each other and a fifth pattern and a sixth pattern juxtaposed with each other, said first position has thereat a first pattern, and said second position has thereat a second pattern, said first and said second circuits are respectively connected with said first and second patterns;

wherein said first pattern includes a first temperature display and a third pattern, said second pattern includes a second temperature display and a fourth pattern;

said third and fourth patterns on said pattern interface are respectively in a simple shape of a man; and said mutually juxtaposed fifth and sixth patterns are respectively in a simple upside-down shape of a man and overlap said third and fourth patterns;

thereby, when a user faces to a front of said receiving bag, the third pattern with said first temperature display and the fourth pattern with said second temperature display are displayed and respectively correspond to said first and said second heating wires; when a user faces to a rear end of said receiving bag, the fifth pattern with said first temperature display and the sixth pattern with said second temperature display are displayed and respectively correspond to said first and said second heating wires; said third and fifth patterns correspond to said first heating wire while said fourth and sixth patterns correspond to said second heating wire by switching between said first and said second circuits with said switchable switch; and heating temperatures of said two sets of heating wires are controlled respectively by emitting control signal from said signal emitting end.

6. The dual-person electric heating blanket as in claim 5, wherein said first circuit is electrically connected with said third and said fifth patterns; and said second circuit is electrically connected with said fourth and said sixth patterns.

7. The dual-person electric heating blanket as in claim 5, wherein said remote controller is provided therewith two push buttons which are connected to an electric circuit board to respectively control said two control circuits, and to respectively adjust heating temperatures of said two sets of heating wires.

8. The dual-person electric heating blanket as in claim 5, wherein said first and second circuits are integrated into a circuit.

* * * * *